US009624789B2

(12) United States Patent
Webster

(10) Patent No.: US 9,624,789 B2
(45) Date of Patent: Apr. 18, 2017

(54) TURBOMACHINE CASING ASSEMBLY

(75) Inventor: John R Webster, Derby (GB)

(73) Assignee: ROLLS-ROYCE PLC, London (GB)

( * ) Notice: Subject to any disclaimer, the term of this patent is extended or adjusted under 35 U.S.C. 154(b) by 574 days.

(21) Appl. No.: 13/817,557

(22) PCT Filed: Aug. 4, 2011

(86) PCT No.: PCT/EP2011/063429
§ 371 (c)(1),
(2), (4) Date: Feb. 22, 2013

(87) PCT Pub. No.: WO2012/025358
PCT Pub. Date: Mar. 1, 2012

(65) Prior Publication Data

US 2013/0149132 A1 Jun. 13, 2013

(30) Foreign Application Priority Data

Aug. 23, 2010 (GB) ..... 1014022.6

(51) Int. Cl.
*F01D 25/24* (2006.01)
*F01D 11/12* (2006.01)
(Continued)

(52) U.S. Cl.
CPC ..... *F01D 25/24* (2013.01); *F01D 11/12* (2013.01); *F01D 11/18* (2013.01); *F01D 25/06* (2013.01);
(Continued)

(58) Field of Classification Search
CPC ..... F01D 11/08; F01D 11/12; F01D 11/122; F01D 11/125; F01D 11/127; F01D 25/24
(Continued)

(56) References Cited

U.S. PATENT DOCUMENTS 4,122,672 A * 10/1978 Lowrie ..... 60/226.1
4,132,069 A 1/1979 Adamson et al.
(Continued)

FOREIGN PATENT DOCUMENTS

DE 31 47 713 A1 6/1982
DE 101 40 742 A1 6/2002
(Continued)

OTHER PUBLICATIONS

International Search Report issued in International Patent Application No. PCT/EP2011/063429 dated Nov. 24, 2011.
(Continued)

*Primary Examiner* — Phutthiwat Wongwian
*Assistant Examiner* — Jessica Kebea
(74) *Attorney, Agent, or Firm* — Oliff PLC

(57) ABSTRACT

A turbomachine casing assembly including a casing adapted to encase an aerofoil structure, the aerofoil structure having a tip, a leading edge and a trailing edge, the casing substantially surrounding the tip of the aerofoil structure, wherein the casing has a set-back portion extending from a position in the region of the leading edge or the trailing edge of the aerofoil structure part way towards a position in the region of the respective other edge and set back from the remainder of the casing away from the aerofoil structure, such that the set-back portion permits a flow over a corresponding portion of the tip of the aerofoil structure.

9 Claims, 4 Drawing Sheets

(51) Int. Cl.

| | |
|---|---|
| ***F01D 11/18*** | (2006.01) |
| ***F01D 25/06*** | (2006.01) |
| ***F04D 29/32*** | (2006.01) |
| ***F04D 29/66*** | (2006.01) |

(52) U.S. Cl.
CPC ..... *F04D 29/324* (2013.01); *F04D 29/666* (2013.01); *F04D 29/668* (2013.01); *F05D 2260/96* (2013.01)

(58) Field of Classification Search
USPC ..... 415/914
See application file for complete search history.

(56) References Cited

U.S. PATENT DOCUMENTS

| | | | | |
|---|---|---|---|---|
| 4,405,284 | A * | 9/1983 | Albrecht et al. | 415/174.4 |
| 4,531,362 | A * | 7/1985 | Barry | F01D 25/06 415/119 |
| 4,540,335 | A * | 9/1985 | Yamaguchi et al. | 415/129 |
| 5,474,417 | A | 12/1995 | Privett et al. | |
| 5,762,470 | A * | 6/1998 | Gelmedov | F04D 29/4213 415/119 |
| 6,454,527 | B2 * | 9/2002 | Nishiyama | F01P 11/12 264/51 |
| 6,457,939 | B2 * | 10/2002 | Ghasripoor et al. | 415/174.4 |
| 6,971,841 | B2 * | 12/2005 | Care | 415/9 |
| 7,210,905 | B2 * | 5/2007 | Lapworth | F04D 29/526 415/220 |
| 7,775,766 | B2 * | 8/2010 | Meier et al. | 415/173.4 |
| 7,861,823 | B2 * | 1/2011 | Prasad et al. | 181/214 |
| 7,914,251 | B2 * | 3/2011 | Pool et al. | 415/9 |
| 8,444,371 | B2 * | 5/2013 | John et al. | 415/1 |
| 8,500,390 | B2 * | 8/2013 | Wojtyczka | F04D 29/526 415/173.4 |
| 8,650,753 | B2 * | 2/2014 | Sellars et al. | 29/888.3 |
| 8,662,834 | B2 * | 3/2014 | Kray et al. | 415/173.4 |
| 8,876,466 | B2 * | 11/2014 | Pattinson et al. | 415/116 |
| 2002/0131858 | A1 | 9/2002 | Adams | |
| 2005/0089390 | A1 * | 4/2005 | Gerain et al. | 415/9 |
| 2005/0111966 | A1 * | 5/2005 | Metheny | 415/116 |
| 2006/0260293 | A1 * | 11/2006 | Launders | 60/226.1 |
| 2009/0246007 | A1 | 10/2009 | Johann | |
| 2010/0143103 | A1 * | 6/2010 | Sellars et al. | 415/173.4 |
| 2010/0329863 | A1 * | 12/2010 | Kray | F01D 5/20 416/1 |

FOREIGN PATENT DOCUMENTS

| | | | |
|---|---|---|---|
| EP | 0 151 071 | A2 | 8/1985 |
| EP | 1 008 758 | A2 | 6/2000 |
| EP | 2 230 387 | A2 | 9/2010 |
| FR | 2 393 994 | A1 | 1/1979 |
| GB | 2 017 228 | A | 10/1979 |
| GB | 2 090 334 | A | 7/1982 |
| GB | 2 092 681 | A | 8/1982 |
| JP | U-3-27803 | | 3/1991 |
| JP | A-3-160198 | | 7/1991 |
| WO | WO 2009/125135 | A2 | 10/2009 |

OTHER PUBLICATIONS

British Search Report issued in British Patent Application No. GB 1014022.6 dated Dec. 6, 2010.

Written Opinion of the International Searching Authority issued in International Patent Application No. PCT/EP2011/063429 dated Nov. 24, 2011.

* cited by examiner

TURBOMACHINE CASING ASSEMBLY

The present invention relates to a casing for a blade, for example a fan blade as may be used in a turbofan gas turbine engine.

Fan flutter and other vibration continues to be a significant issue. The traditional route to reduce this is to avoid engine running ranges or blade/fan set vibration modes, but this is particularly difficult at take off. Alternative methods include re-camber and increased blade chord.

Turbofan clapperless fan blades may suffer from vibration where aerodynamic forces lead to excitation of a fan blade's natural modes of vibration, e.g. second flap mode, away from coincidence with the harmonics of a fan blades rotational speed, i.e. a non integral vibration.

Flutter has continued to cause difficulties for many years, there is no fundamental solution which can be applied without a major performance penalty. As a result engines are designed as close to the limit as possible. Partial solutions which are used when flutter cannot be designed out include rolling take off and keep out zones, both of which are unattractive from an operational stand point.

Furthermore, re-camber and increased blade chord, reduce efficiency and increase weight respectively.

Accordingly the present invention seeks to address these issues.

According to the present invention there is provided a turbomachine casing assembly comprising a casing adapted to encase an aerofoil structure, the aerofoil structure having a tip, a leading edge and a trailing edge, the casing substantially surrounding the tip of the aerofoil structure, wherein the casing has a set-back portion extending from a position in the region of one of the leading edge and the trailing edge of the aerofoil structure part way towards a position in the region of the other of the leading edge and trailing edge and set back from a portion of the casing adjacent to the aerofoil structure and away from the aerofoil structure, such that the set-back portion permits a flow over a corresponding portion of the tip of the aerofoil structure.

The turbomachine casing assembly may further comprise a porous liner provided in the set-back portion of the casing. The porous liner may be capable of permitting the flow over the tip of the aerofoil structure to pass through the porous liner.

The porous liner may be abradable. The porous liner may comprise an open-celled foam. The porous liner may comprise a honeycomb structure.

A porosity of the porous liner may be selected so that the flow through the porous liner may be dominated by a portion of the flow through the porous liner closer to the tip of the aerofoil structure.

A surface of the porous liner facing the tip of the aerofoil structure may be level with the portion of the casing adjacent to the aerofoil structure. The portion of the casing adjacent to the aerofoil structure may comprise an abradable liner.

The aerofoil structure may rotate with respect to the casing. The aerofoil structure may be a fan blade. A turbomachine may comprise the turbomachine casing assembly described above. A gas turbine engine may comprise the turbomachine casing assembly described above.

In summary, embodiments of the present invention may provide for blade vibration damping by utilising passive modulation of blade tip clearance. Embodiments of the present invention may provide for extended blade life due to reduction in high cycle fatigue, reduced blade generated noise due to blade damping, reduced blade tip generated noise due to disrupted over tip vortex. With embodiments of the present invention problems of reduced fan efficiency and/or increased weight may be at least mitigated. Tip clearance modulation in accordance with embodiments of the present inventions may have a significant effect on blade vibration, for example in fans and/or compressors.

For a better understanding of the present invention, and to show more clearly how it may be carried into effect, reference will now be made, by way of example, to the accompanying drawings, in which:—

Figure 3:
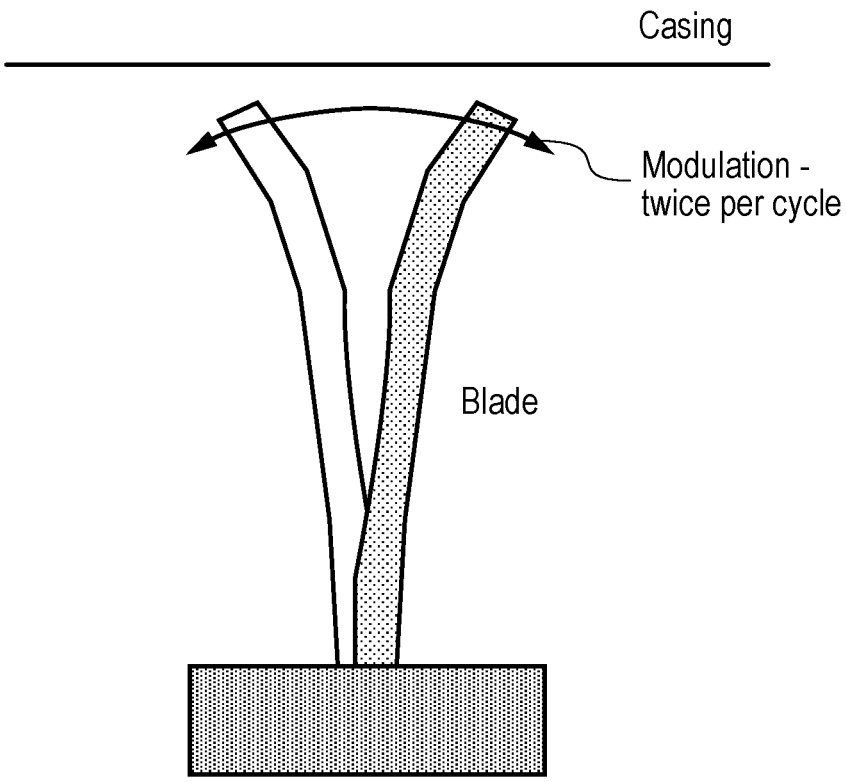
Figure 4:
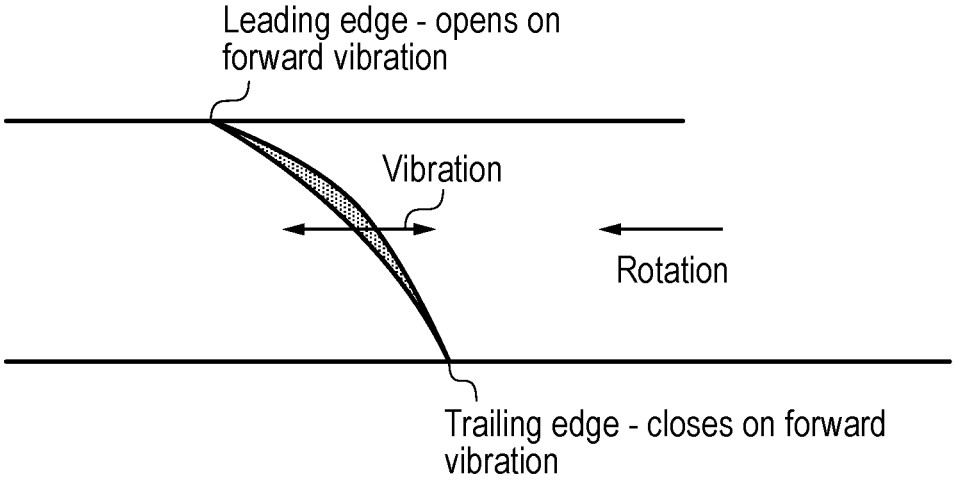
Figure 5:
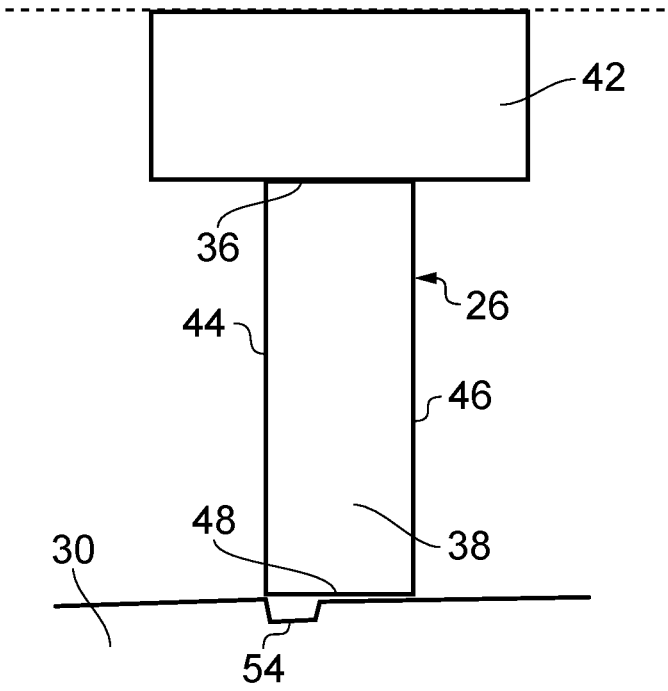
Figure 6:
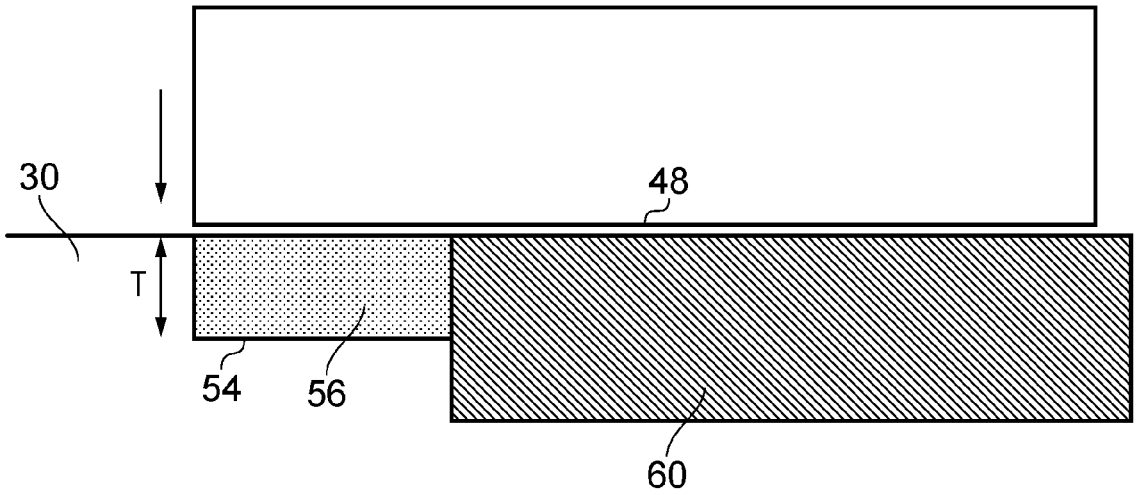
Figure 7:
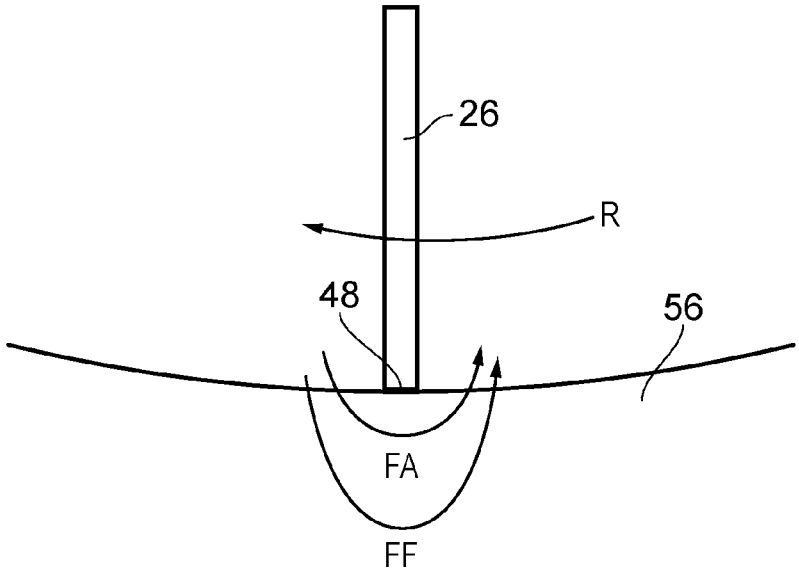

FIG. 3 schematically illustrates a simplified tip modulation scenario, for assistance in understanding the present invention;

FIG. 4 schematically illustrates tip opening on a twisted fan blade for assistance in understanding the present invention;

FIGS. 5 and 6 schematically illustrate a casing assembly in accordance with embodiments of the invention; and FIG. 7 schematically illustrates flow paths through the casing assembly of the present invention.

Figure 1:
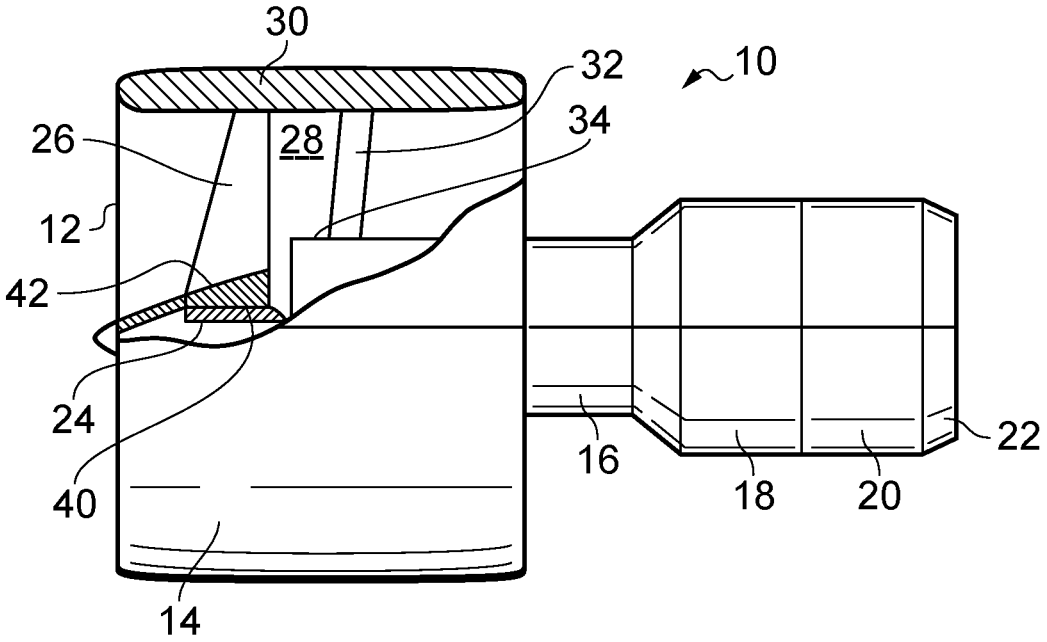
FIG. 1 shows a turbofan gas turbine engine having a fan blade to which the present invention can be applied.

A turbofan gas turbine engine 10, as shown in FIG. 1, comprises in flow series an inlet 12, a fan section 14, a compressor section 16, a combustion section 18, a turbine section 20 and an exhaust 22. The fan section 14 comprises a fan rotor 24 carrying a plurality of circumferentially spaced radially outwardly extending fan blades 26. The fan blades 26 are arranged in a bypass duct 28 defined by a fan casing 30, which surrounds the fan rotor 24 and fan blades 26. The fan casing 30 is secured to a core engine casing 34 by a plurality of circumferentially spaced radially extending fan outlet guide vanes 32. The fan rotor 24 and fan blades 26 are arranged to be driven by a turbine (not shown) in the turbine section 20 via a shaft (not shown). The compressor section 16 comprises one or more compressors (not shown) arranged to be driven by one or more turbines (not shown) in the turbine section 20 via respective shafts (not shown).

Figure 2:
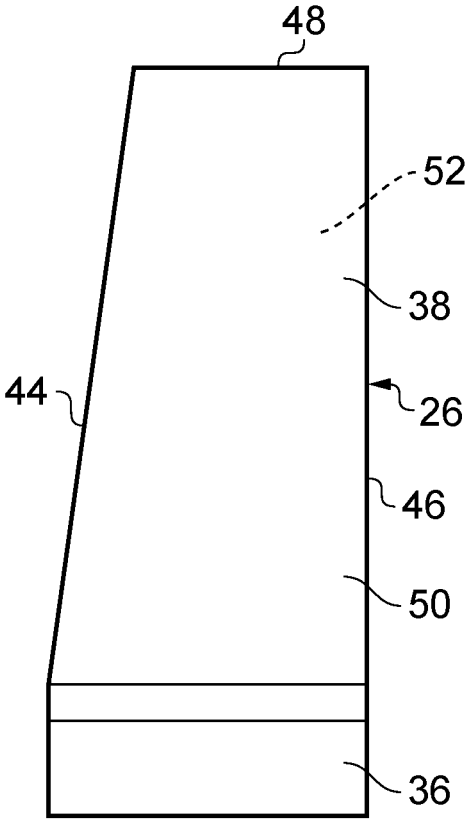
FIG. 2 shows a fan blade to which the present invention can be applied.

An exemplary fan blade 26 to which the present invention may relate is shown more clearly in FIG. 2. The fan blade 26 comprises a root portion 36 and an aerofoil portion 38. The root portion 36 is arranged to locate in a slot 40 in the rim 42 of the fan rotor 24, and for example the root portion 36 may be dovetail shape, or fir-tree shape, in cross-section and hence the corresponding slot 40 in the rim 42 of the fan rotor 24 is the same shape. The aerofoil portion 38 has a leading edge 44, a trailing edge 46 and a tip 48 remote from the root portion 36 and the fan rotor 24. A concave pressure surface 50 extends from the leading edge 44 to the trailing edge 46 and a convex suction surface 52 extends from the leading edge 44 to the trailing edge 46.

Aerodynamic disturbances caused by vibration of the blades 26 could excite appropriate modes in the casing 30 that would in turn modulate the tip clearance. It is suspected that changes in tip clearance cause a modulation in the energy loss due to tip leakage and hence a modulation in the aerodynamic loading, particularly around the tip 48. This loading modulation can provide a vibration excitation. Dependent on modal coincidences, mode strengths and exact phasing, the mechanism can provide strong excitation or damping.

Small changes in tip clearance may cause major performance penalties i.e. energy loss. This energy loss may be manifested as a reduction of the blade loading around the tip. A modulation in this energy loss can provide vibration forcing/damping.

A simplified illustration is shown in FIG. 3, which schematically illustrates tip modulation. In FIG. 3, a blade is modeled as a flat plate, which operates close to a further flat plate (which represents a casing). As shown, a flap mode will provide a tip clearance modulation. This modulation opens the gap at the maximum displacement on each half-vibration cycle, so that the modulation occurs at twice the vibration frequency.

Since this is frequency doubled, it can have no effect on the blade vibration in the flap mode. However, in accordance with the present invention it has been appreciated that it is desirable to modulate once per cycle. Such a modulation has the potential to provide an aerodynamic forcing which is at the same frequency as the blade vibration and the phase of this forcing may be changed by 180° to provide damping.

The real situation is more complex than is illustrated in FIG. 3. For example, the casing may be curved and the fan blade may comprise high levels of blade twist, which gives significant modification to the tip motion. The effect will increase towards the leading and trailing edges. In the case of a twisted blade, the motion is not perpendicular to the tip aerofoil with modulation once per cycle. FIG. 4 schematically illustrates tip opening on a twisted fan blade.

With a simple model, the effect from the leading and trailing edges would however be equal and opposite so would cancel each other out. Asymmetry in geometry or local aerodynamic loading could lead to an out of balance effect that will result in blade forcing. This may be likely to occur in existing designs and may be the root of some vibration problems. However, in accordance with the present invention, this effect may be enhanced by deliberately increasing the tip clearance towards the leading or trailing edge such that it would reduce the effect in that region, leaving the other edge to dominate and provide a useful effect.

Accordingly, with reference to FIG. 5, a turbomachine casing assembly according to the present invention comprises a casing 30 adapted to encase an aerofoil structure 26. The aerofoil structure 26, for example a blade and in particular a fan blade, comprises a root portion 36 and an aerofoil portion 38, the aerofoil portion 38 having a tip 48 remote from the root portion 36, and a leading edge 44 and a trailing edge 46. The casing 30 substantially surrounds the tip 48 of the aerofoil structure.

The casing 30 comprises a set-back portion 54 extending from a position in the region of one of the leading edge 44 and the trailing edge 46 of the aerofoil structure 26 part way towards a position in the region of the other of the leading edge 44 and trailing edge 46 and set back from a portion of the casing adjacent to the aerofoil structure (i.e. the remainder of the casing) and away from the aerofoil structure 26. In the example shown in FIG. 5, the set-back portion 54 extends from a position opposite the leading edge 44 part way towards a position opposite the trailing edge 46. In another example (not shown), the set-back portion 54 may extend from a position opposite the trailing edge 46 part way towards a position opposite the leading edge 44.

In the specific embodiment described, and shown in FIG. 5, the set-back portion 54 extends from a position opposite the leading edge 44 of the aerofoil structure 26. More generally, though, in order to achieve the objects of the invention, it is only necessary for the set-back portion to be biased towards one of the leading edge and the trailing edge, so as to provide an unbalanced aerodynamic forcing effect. Accordingly, the set-back portion need not be aligned precisely opposite the leading edge or the trailing edge.

The set-back portion 54 permits a deliberate flow beyond that which would otherwise occur due to leakage over a corresponding portion of the tip 48 of the aerofoil structure 26. The corresponding portion is a portion of the tip 48, which is opposite the set back portion of the casing. The set-back portion may for example be dimensioned to increase the tip clearance area (compared to a casing without the set-back portion) vis-à-vis the casing equivalent to 1% of the aerofoil structure (e.g. fan) area.

The present invention may have the effect of creating an imbalance between the opposing forces at the leading and trailing edge as the aerofoil structure vibrates. For example, as shown in FIG. 4, when a blade vibrates in a forward direction the tip clearance gap may open at the leading edge and close at the trailing edge (and vice versa for vibrations in the reverse direction). The resulting forces due to flow over the tip and through the tip clearance gap may cancel each other out or there may be a net force acting on the blade. A net force may oscillate at the same rate at which the blade vibrates and such a force may reinforce or dampen the blade vibrations. By increasing the tip clearance at the leading or trailing edge the resulting force on the blade may be manipulated to ensure that the blade vibrations are damped. In other words, the tip clearance may be increased at the leading or trailing edge to change the force acting on the trailing or leading edge such that there is a net restoring force acting on a blade perturbed from its original position. Accordingly, the choice of whether the set back portion is at the leading edge or trailing edge will depend upon the particular application and the phasing of the vibration. Furthermore, the present invention may comprise a balanced mechanism in a twisted fan blade such that the leading and trailing edges have roughly equal and opposite effects on the over tip leakage and hence the vibration damping.

However, the set back portion 54 may have the drawback of changing depth with any rub and subsequent removal of the abradable lining of casing 30. This change in depth would change the effectiveness of the mechanism or require an excessively deep cut back which would cause a fan efficiency loss. To alleviate this, the cut back 54 may be filled with a porous or flow reducing medium, which may be level with the abradable lining and may also be abradable by tip rubs.

Accordingly, with reference to FIG. 6, the turbomachine casing assembly may further comprise a porous liner or filler 56 provided in the set-back portion 54 of the casing 30. The porous liner 56 may be capable of permitting the flow over the tip 48 of the aerofoil structure 26 to pass through the porous liner.

The porous liner 56 may be abradable. As such, the thickness T of the porous liner may be abraded by the blade tip 48. A surface of the porous liner facing the tip 48 of the aerofoil structure 26 may be level with the remainder of the casing 30. The remainder of the casing 30 may comprise an abradable liner 60. The porous filler 56 may be an open celled foam.

With reference to FIG. 7, flow paths over the tip 48 of the aerofoil structure 26 rotating in a direction R are shown. A porosity of the porous liner 56 may be selected so that the flow through the porous liner may be dominated by a portion of the flow FA through the porous liner closer to the tip 48 of the aerofoil structure 26, as opposed to a portion of the flow FF further away from the tip 48 of the aerofoil structure 26. For example, a foam's characteristics (e.g. cell size, shape, openness etc) may be chosen to give a porosity which provides a balance between an excessive over tip leakage and a desirable small increase in the over tip leakage.

Accordingly, the porosity of the porous liner 56 may be chosen so that a fluid flows more readily closer to the liner 56 surface. In other words, the flow FA adjacent to the surface of the liner 56 is resisted less than the flow FF further away from the surface. In this way, the depth of the filler 56 does not have a major influence on its porosity and the tip leakage is not unduly affected by any tip rubbing.

The porous lining 56 may comprise a honeycomb structure with suitable passages made between the cells. These may be made below the level where the material is intended to be abraded so that they may not change as the material is removed.

The present invention alleviates or reduces blade flutter by a purely passive means. In other words, the present invention damps blade vibration by utilising passive modulation of the blade tip clearance. As a result, the blade life may be extended due to a reduction in high cycle fatigue. Likewise, noise levels may be reduced due to the blade damping and the disrupted over tip vortex. The present invention may achieve these advantages without reducing the fan efficiency and/or increasing the weight, which may be the case for current solutions to the aforementioned problem.

The present invention is for example applicable to clapperless fan blades which lead to excitation of other natural modes of vibration, e.g. first flap mode, third flap mode, first torsion mode, second torsion mode or combinations thereof or any of the first ten fundamental vibration modes. The present invention is applicable to metal fan blades and fan blades having a hybrid structure, e.g. composite fan blades. In the case of some designs of hybrid structured fan blades there may be other natural modes of vibration that are not easy to describe using first flap mode, second flap mode, third flap mode, first torsion mode or second torsion mode because the complex structure of these hybrid structured fan blades may distort such mode shapes out of recognition.

The present invention is however also applicable to other fan or turbine applications or turbomachinery blades, including e. g. fans in ventilation subsystems or automotive applications, centrifugal compressors etc.

The invention claimed is:

1. A turbomachine casing assembly comprising a casing adapted to encase an aerofoil structure, the aerofoil structure having a tip, a leading edge and a trailing edge, wherein the casing has a set-back portion radially outward of either the leading edge or the trailing edge so as to increase the tip clearance in the region of the leading edge or trailing edge, and wherein the casing has no set-back portion radially outward of the other of the leading edge and trailing edge, wherein the turbomachine casing assembly further comprises a porous liner provided in the set-back portion of the casing, the porous liner being capable of permitting the flow over the tip of the aerofoil structure to pass through the porous liner, and wherein a porosity of the porous liner is selected so that the flow through the porous liner in an area adjacent to a surface of the porous liner is resisted less than the flow through the porous liner in an area further away from the surface.

2. A turbomachine casing assembly as claimed in claim 1, wherein the porous liner is abradable.

3. A turbomachine casing assembly as claimed in claim 1, wherein the porous liner comprises an open-celled foam.

4. A turbomachine casing assembly as claimed in claim 1, wherein the porous liner comprises a honeycomb structure.

5. A turbomachine casing assembly as claimed in claim 1, wherein the aerofoil structure is a fan blade.

6. A turbomachine comprising the turbomachine casing assembly of claim 1.

7. A gas turbine comprising the turbomachine casing assembly of claim 1.

8. A turbomachine casing assembly as claimed in claim 1, wherein the increased tip clearance is configured to give rise to an unbalanced aerodynamic forcing effect on the aerofoil.

9. A turbomachine casing assembly as claimed in claim 1, wherein a porosity of the porous liner adjacent to a surface of the porous liner is greater than a porosity of the porous liner further away from the surface.

* * * * *